US009424973B2

(12) United States Patent
Roellgen et al.

(10) Patent No.: US 9,424,973 B2
(45) Date of Patent: Aug. 23, 2016

(54) COIL AND METHOD FOR PRODUCING A COIL

(75) Inventors: Bernhard Roellgen, Munich (DE); Herbert-Maurizio Cardarelli, Munich (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 12/889,645

(22) Filed: Sep. 24, 2010

(65) Prior Publication Data

US 2011/0068886 A1 Mar. 24, 2011

Related U.S. Application Data

(63) Continuation of application No. PCT/EP2009/053391, filed on Mar. 23, 2009.

(30) Foreign Application Priority Data

Mar. 31, 2008 (DE) ..... 10 2008 016 488

(51) Int. Cl.

| | |
|---|---|
| ***H01F 27/28*** | (2006.01) |
| ***H01F 27/24*** | (2006.01) |
| ***H01F 17/04*** | (2006.01) |
| *H01F 27/02* | (2006.01) |
| *H01F 27/32* | (2006.01) |
| *H01F 41/12* | (2006.01) |

(52) U.S. Cl.

CPC ..... *H01F 17/045* (2013.01); *H01F 41/069* (2016.01); *H01F 41/084* (2016.01); *H01F 27/022* (2013.01); *H01F 27/2828* (2013.01); *H01F 27/323* (2013.01); *H01F 41/127* (2013.01); *Y10T 29/49071* (2015.01)

(58) Field of Classification Search

CPC ..... H01F 41/0633
USPC ..... 336/180
See application file for complete search history.

(56) References Cited

U.S. PATENT DOCUMENTS

| | | | | |
|---|---|---|---|---|
| 2,528,667 | A * | 11/1950 | Raabe | 343/866 |
| 3,125,133 | A | 3/1964 | Klingensmith et al. | |
| 4,255,734 | A * | 3/1981 | Owen | 336/147 |
| 5,107,366 | A * | 4/1992 | Huang et al. | 359/223.1 |
| 6,967,554 | B2 * | 11/2005 | Eydelie et al. | 336/180 |
| 2004/0136559 | A1 | 7/2004 | Suzuki | |
| 2004/0150500 | A1 * | 8/2004 | Kiko | 336/90 |
| 2004/0251523 | A1 * | 12/2004 | Takiar | 257/673 |
| 2010/0175244 | A1 | 7/2010 | Nemoto | |
| 2012/0007695 | A1 | 1/2012 | Roellgen et al. | |

FOREIGN PATENT DOCUMENTS

| | | |
|---|---|---|
| CN | 101040352 A | 9/2007 |
| DE | 1 203 873 | 10/1965 |

(Continued)

OTHER PUBLICATIONS

English translation of JP2005327834A.*

*Primary Examiner* — Mangtin Lian
*Assistant Examiner* — Ronald Hinson
(74) *Attorney, Agent, or Firm* — Slater Matsil, LLP

(57) ABSTRACT

A coil is specified which has at least four electrical conductors, wherein the electrical conductors are wound around a common winding center. Each of the at least four electrical conductors is at a constant distance from the winding center of the coil over the entire length of the coil.

24 Claims, 3 Drawing Sheets

(56) References Cited

FOREIGN PATENT DOCUMENTS

| | | | | |
|---|---|---|---|---|
| DE | 977 571 | | | 4/1967 |
| DE | 2323821 | A | * | 11/1974 |
| DE | 44 32 739 | B4 | | 3/1996 |
| JP | 62-004121 | A | | 1/1987 |
| JP | 04-359502 | A | | 12/1992 |
| JP | 11-135319 | A | | 5/1999 |
| JP | 2000-082628 | A | | 3/2000 |
| JP | 2003-86427 | | | 3/2003 |
| JP | 2004-221651 | A | | 8/2004 |
| JP | 2005136341 | | | 5/2005 |
| JP | 2005-209916 | A | | 8/2005 |
| JP | 2005-327834 | A | | 11/2005 |
| JP | 2007209140 | | | 8/2007 |
| JP | 2008-060432 | a | | 3/2008 |
| WO | 2010089413 | A1 | | 8/2010 |

* cited by examiner

COIL AND METHOD FOR PRODUCING A COIL

This application is a continuation of co-pending International Application No. PCT/EP2009/053391, filed Mar. 23, 2009, which designated the United States and was not published in English, and which claims priority to German Application No. 10 2008 016 488.7, filed Mar. 31, 2008, both of which applications are incorporated herein by reference.

TECHNICAL FIELD

The invention relates to a coil and a method for producing coils.

BACKGROUND

An inductive electrical component is disclosed in German publication DE 44 32 739 B4.

SUMMARY OF THE INVENTION

In one aspect, an embodiment of the present invention is a coil which has a winding which closely approximates the theoretically ideal winding.

An embodiment coil is specified which comprises at least four electrical conductors. The electrical conductors are wound around a common winding center. Each of the at least four electrical conductors is at a constant distance from the winding center of the coil over the entire length of the coil. The winding center is understood to be the respective geometrical midpoint of the windings. Considered over the entire length of the coil, the winding center corresponds, for example, to the longitudinal axis of the coil. The individual windings of each individual electrical conductor are arranged adjacent to one another over the entire length of the coil. The windings of the next adjacent electrical conductor towards the outside are arranged directly on top of the windings of the electrical conductors which are arranged further inwards. The distance of the first electrical conductor is constant over the entire length of the coil. Depending on their position, the distances of the further electrical conductors are at a greater distance from the winding center, the distance of each individual electrical conductor preferably remaining constant over the entire length of the coil.

Preferably, the electrical conductors are insulated with respect to one another in the vicinity of the coil windings. The mutual insulation of the conductors reduces eddy current losses to a minimum.

Preferably, the at least four electrical conductors are electrically conductively connected to one another at the respective ends of the coil so that the conductors are preferably connected in parallel. In order to connect the electrical conductors in parallel, the electrical conductors are preferably connected to one another at least at the ends of the coil by means of solder links. The equalizing currents flowing through the individual electrical conductors are thereby minimized within the winding.

In a preferred embodiment, the coil is suitable particularly for high-frequency applications. However, it is also possible for the coil to be used with high currents, for example. In this case, the current which flows through the coil is divided between the at least four parallel-running electrical conductors. As a result of the almost ideal type of winding, the coil can be used in almost any field in which coils of this kind are required.

In a preferred embodiment, the electrical conductors comprise individual wires which are twisted together. In this case, the wires are preferably twisted stranded conductors with thin individual wires. Each electrical conductor through which current flows has a certain inductance due to the magnetic field which surrounds it and which is produced by the current. To increase the inductance, the electrical conductor can be provided with a certain number of turns. As a result of the magnetic linkage (flux linkage) of the individual turns between one another caused by the spatially close arrangement of the individual turns, the inductance of wound coils increases quadratically with the number of turns. Twisting the individual wires in an electrical conductor achieves at least a partial superimposition of opposing magnetic fields, wherein the magnetic fields are thereby partially cancelled.

The coil is preferably designed in such a way that the coil has a self-supporting shape as a result of electrical conductors which are mechanically bonded to one another and which are wound around a winding center. The self-supporting shape of the coil is preferably achieved by the electrical conductors which are mechanically bonded to one another. The coil therefore preferably does not require a coil body to maintain the stability of the coil.

The electrical conductors are securely mechanically bonded to one another at least in part.

In a preferred embodiment, the electrical conductors are mechanically bonded to one another at regular or also at irregular intervals. As a result of the bonded electrical conductors which are wound around a common winding center, the coil achieves a self-supporting stability of its shape.

In a preferred embodiment, the electrical conductors are mechanically bonded to one another at regular intervals.

In a further embodiment, it is sufficient when the individual conductors are only bonded to one another at certain points. A complete mechanical bonding of the electrical conductors over the entire length of the coil is not necessary in this case.

In order to mechanically bond the conductors, they can be sleeved with a thermoplastic synthetic material, for example, which when heated, for example, by means of infrared light or a hot air stream, becomes soft and is subsequently removed from the mold and bonds the conductors to one another. Wires which are sleeved with a thermoplastic synthetic material are also referred to as self-bonding wires.

In a further embodiment, the electrical conductors can, for example, be bonded to one another by applying UV-hardening adhesives. The UV-hardening adhesives can be applied, for example, while the individual conductors are on a guide roller. Alternatively, a UV-hardening adhesive can be applied shortly after detaching from the guide roller. In this case, the adhesive is cured by means of UV light, for example, which is produced by means of a UV LED array, for example. Alternatively, a flash lamp can be used, wherein curing takes place as a result of the UV light within 200 ms.

In a further embodiment, the conductors can be mechanically bonded, for example, by sticking them together using a piece of adhesive foil placed beneath them. Sticking together by means of adhesive foil can, for example, take place shortly before a first pressure roller in the vicinity of the guide roller with the upwardly facing adhesive layer.

In a further embodiment, the conductors can, for example, be bonded by interweaving with a synthetic yarn. An example of a suitable base material for the synthetic yarn is polyester. In a further embodiment, the synthetic yarn can be provided with a self-bonding layer or a pressure-sensitive adhesive, for example. The synthetic yarn is inserted between the individual conductors by means of an air stream, for example. The electrical conductors additionally bond with the synthetic yarn by means of pressure, for example. Alternatively, the electrical conductors can bond with the yarn by heating.

The possible ways of bonding the conductors mentioned above can be combined with one another in a suitable manner.

In a preferred embodiment, the coil can have a round, elliptical or rectangular shape for its coil cross section. However, in order to achieve the lowest possible electrical resistance, a circular shape is the best possible shape.

In a preferred embodiment, the inner electrical conductors of the coil have a length which is less than the length of the next adjacent electrical conductor towards the outside. The parallel fed conductors are preferably bonded to one another in such a way that the length of the outermost conductor is greater than the length of the adjacent inner conductor, wherein the length of the electrical conductors therefore reduces towards the inside.

As a result of the different lengths of the electrical conductors which are mechanically bonded to one another, the electrical conductors therefore have a curved shape after bonding. The conductors which are bonded together in this way run in the form of a helical-shaped strip, which corresponds approximately to the shape of an Archimedean screw.

In a preferred embodiment, the respective ends of the electrical conductors have electrical contacts. The beginning and end of each conductor is preferably designed in the form of a connecting pin. When the mechanical loads are low, these connecting pins are sufficient to enable the component to be fitted. When the coil is arranged with a ferrite core, the ends can be formed on the ferrite core as SMD solder surfaces, for example.

In a further preferred embodiment, the ends of the electrical conductors are each connected to separate contact pins. As a result of the additional contact pins or solder pins, higher mechanical loads can be exerted on the contacts without the ends changing their original position and shape.

The inside diameter of a coil as described above can be reduced to a minimum by the type of winding and the self-supporting property described above.

The coil in the form of an air-core coil which is achieved by means of a winding described above can already be used as a component. In this case, the coil has no additional coil body which would contribute to increasing the stability. The theoretically available winding space is therefore fully available. This provides a larger usable winding space.

As no additional coil body is required for stabilizing the coil, extremely thin turns can be achieved. In contrast to conventional flat windings, a large number of electrical conductors can be accommodated in one winding.

This is particularly advantageous for the design of lighting chokes, for example. The design of lighting chokes requires relatively large numbers of turns which are incorporated into flat ferrite cores so that a desired switching frequency of 45 kHz, for example, can be achieved. The total height of choke coils is however restricted by the relatively low height of the standard housing used.

In a further embodiment, a plurality of coils as described above with different diameters can, for example, be placed inside one another or on top of one another. In doing so, the coils are galvanically isolated from one another and therefore have windings which are magnetically coupled. By using two coils, it is therefore possible to form a component which has the function of a transformer. Tubular plastic spacers, for example, can be inserted between the individual coils to provide reliable separation between the individual coils.

In a further embodiment, the coil can have the function of a transformer, for example by interweaving polyester or nylon yarns which are incorporated into the conductors in a suitable manner. In this embodiment, for example, the coil has an inner layer of windings of one or more electrical conductors which are followed by one or more layers of windings of an insulating material. There subsequently follows one or more further layers of windings of an electrical conductor.

So-called ferrite cores are often used to increase the inductance of coils. In this case, the ferrite core is preferably arranged in such a way that the windings of the coil are fed around the ferrite core. Ferrite cores can be designed as ring cores, rod cores or in any other form. An air gap in the otherwise closed path of a ferrite core considerably reduces the magnetic flux density of the core and thus effects a linearization, for example, of the magnetization characteristic of the component according to the relationship between magnetic field strength and magnetic flux density. Magnetic saturation of the core material therefore only occurs at considerably higher field strengths. A significant part of the magnetic energy is stored in the air gap of storage chokes.

When ferrite cores with three legs are used, such as E-cores, for example, which preferably have a large air gap in the area between the two middle legs, it is necessary for the design of particularly low-loss transformers or storage chokes for the windings to maintain a defined minimum distance from the air gap. Coil bodies with a cushion-shaped area of the coil are often used for this purpose. A cushion is understood to mean an area of the coil in which there are no or few windings in the vicinity of the air gap between two ferrite cores. A cushion of this kind can be achieved with the coil described above by spreading out the windings in the vicinity of the air gap for example. If the coil is selectively stretched, only a few windings of the coil are located in the vicinity of the air gap. In order at the same time to stabilize the coil in the vicinity of the cushion, a plastic part in the shape of a circular segment can, for example, be arranged in this area. The plastic part can be inserted in the vicinity of the air gap, for example.

In order to fix the coil, the preferably compressed coil can, for example, be provided with an additional casting compound. On the one hand, the casting compound serves as an insulating protective layer. On the other, the coil is further stabilized by the layer of casting compound.

To produce a coil as described above, at least four electrical conductors are pressed onto a preferably tapered guide roller by means of at least a first and a second tapered pressure roller. The guide roller has guides which are preferably arranged concentrically around the axis of rotation of the guide roller. Preferably, the guide roller has the shape of a truncated cone.

In a preferred embodiment, the guides can be arranged on the guide roller in the form of groove-shaped, concentric recesses. Each of the at least four electrical conductors is guided in a separate guide of the guide roller. The electrical conductors are preferably mechanically bonded to one another while passing around the guide roller. After passing around the guide roller, the electrical conductors have the shape of a helical strip.

As a result of the mechanical bonding of the individual conductors and as a result of passing around the guide roller, the electrical conductors automatically bend to form a helical strip. In the case of a theoretically endlessly long strip of conductors linked in this way, an endless helical strip, which bears a similarity to an Archimedean screw, would be formed.

With regard to shape and size, the pressure rollers are preferably applied to the guide roller with an accurate fit. The first pressure roller advances the electrical conductors towards the guide roller at the speed corresponding to the respective radius of the guide roller. In order to reliably guide the individual electrical conductors in the guides of the guide roller, the second pressure roller is likewise matched to the guide roller with an accurate fit.

Preferably, the conductors are mechanically bonded to one another when passing around the guide roller. The individual conductors can be bonded according to the alternatives described above for the component, for example.

For additional fixing, the preferably compressed coil can be immersed after winding in a trough with casting compound. This results in a protective layer which further fixes the winding. This also provides the winding with an insulating protective layer.

A further preferred method for producing a coil is a method in which at least four electrical conductors are wound around a rotating axle of a winding tool by means of a wire guide. In this case, each of the at least four electrical conductors has a separate wire guide. Preferably, the individual wire guides are arranged adjacent to one another in a single component. The electrical conductors are wound around the axis of rotation in a winding plane which is arranged perpendicular to the axis of rotation of the winding tool. As the number of windings increases, the wire guide is fed parallel to the axis of rotation so that a winding is produced. The electrical conductors are preferably mechanically bonded to one another during winding.

At the start of the winding process, the first ends of the electrical conductors are laid in a guide of a first winding tool. The guide can be formed, for example, by a slot or recess in the winding tool. The electrical conductors are fixed in the recess by means of a magnet, for example.

The inside diameter of the coil to be wound is determined by the outside diameter of the rotating axle about which the conductors are wound.

Preferably, the wire guide moves in the direction of winding at the speed at which the already wound winding grows. A plate, which is arranged on the wire guide and which is arranged concentrically about the axis of rotation, can be used, for example, to exert pressure on the already fully wound region of the coil so that the position of this region can no longer change. When the wire guide has reached the end of the coil to be wound, the wire ends can be placed manually, for example, in further slot-shaped recesses of a second winding tool. The second winding tool is connected to the first winding tool by means of a coupling, for example, and rotates at the same speed and in the same direction as the first winding tool.

To fix the winding when using conductors which are sleeved with a thermoplastic synthetic layer, for example, the winding is heated above the softening temperature of the thermoplastic synthetic layer during the winding process with an infrared radiator or a hot air stream. After cooling below the softening temperature of the thermoplastic synthetic layer, the winding can be removed from the winding tool which gives it its shape. At the same time, the ends which were previously placed in the recesses of the winding tools are removed therefrom.

Alternatively, the coil can be fixed by means of a rapidly curing adhesive, for example, which is applied simultaneously during winding. Any type of conductor can be used in this case. The adhesive can penetrate the complete winding, for example. In a further embodiment, an adhesive layer can also be applied to only the end or beginning of the winding. When winding tools made of Teflon are deployed, acrylate adhesives or epoxy resins, for example, can also be used without problems occurring when removing from the mold.

For additional fixing, the preferably compressed coil can be immersed after winding in a trough with casting compound. This results in a protective layer which further fixes the winding. This also provides the winding with an insulating protective layer.

The coil described above is preferably used as a high-frequency choke in the range from 30 kHz to well over 5 MHz.

As a result of the low-capacitance design of the coil which results, for example, from the use of twisted stranded conductors which are stacked on top of one another, a high Q factor is achieved.

A reduction in the proximity effect is achieved by using twisted stranded conductors. In one embodiment, stranded conductors with 30 to 50 twists/meter are used. Preferably, stranded conductors with a number of preferably up to 200 twists per meter are used.

At low frequencies, the coil has a high DC resistance compared with a flat winding. At high frequencies, however, the HF resistance does not increase as strongly as that of flat windings or conventional windings (layer windings). A layered winding with, for example, 27 turns on, for example, a core in RM6 design made from N49 material with an air gap of 0.4 mm and at a frequency of 350 kHz has a resistance of 0.78 ohms, and at 750 kHz a resistance of 2.86 ohms. A winding as described above with the same number of turns and the same core has a resistance of 1 ohm at 350 kHz but a resistance of only 2 ohms at 750 kHz.

Because of the higher Q factor, the coil has a narrower and higher resonance curve at high frequencies (e.g., 500 kHz) when excited at the third, fifth and seventh harmonic.

BRIEF DESCRIPTION OF THE DRAWINGS

The subject matter described above is explained in more detail with reference to the following figures and exemplary embodiments.

The drawings described below are not to be regarded as being to scale. Rather, individual dimensions may be shown increased in size, reduced or even distorted for better clarity. Elements which are the same as one another or which undertake the same functions are designated with the same references.

Figure 1:
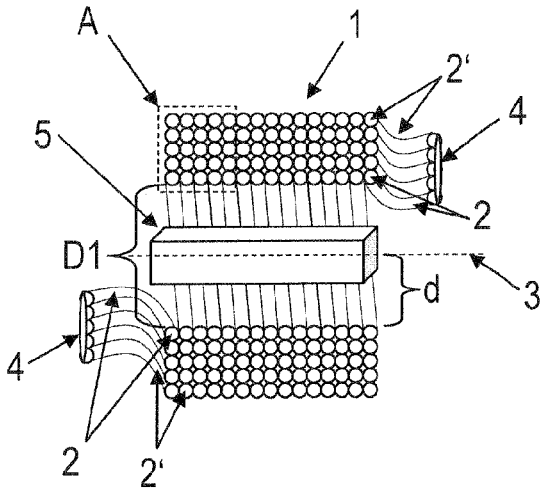
FIG. 1 shows a schematic design of a coil.

The following list of reference symbols may be used in conjunction with the drawings:

1 Coil
2, 2' Electrical conductors
3 Winding center
4 Electrical contacts
5 Ferrite core
A Section
10 First pressure roller
11 Second pressure roller
12 Guide roller
13 Guides
14 Collection cup
15 Infrared linear radiator
16 Mechanical bond
100 Wire guide

101 Rotating axle
102, 103 Winding tool
104 Plate
105 Recess
106 Magnet
107 Coupling
d Distance from an electrical conductor (2, 2') to the winding center 3
D1 Inside diameter of the coil 1
D2 Outside diameter of the rotating axle 101

DETAILED DESCRIPTION OF ILLUSTRATIVE EMBODIMENTS

Figure 5:
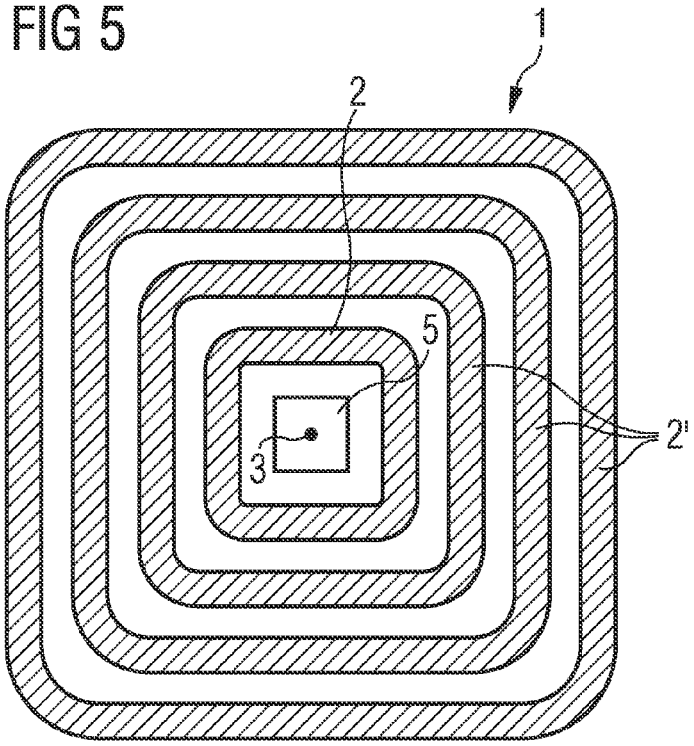
FIG. 5 shows a cross-sectional view of one example of FIG. 1.

FIG. 1 shows a schematic sketch of a first embodiment of a coil 1. A plurality of electrical conductors 2, 2' is wound around a common winding center 3. The distance d of the electrical conductor 2 from the longitudinal axis of the coil 1 is the same magnitude over the entire length of the coil 1. The distances of the further electrical conductors 2' from the longitudinal axis of the coil 1 are likewise approximately constant over the entire length of the coil 1. The coil 1 has an inside diameter D1 which is approximately the same magnitude over the entire length of the coil 1. The electrical conductors 2, 2' of a winding plane are preferably arranged uniformly on top of one another. Winding the electrical conductors 2, 2' together enables the electrical conductors 2, 2' to lie directly on top of one another. Preferably, the electrical conductors 2, 2' are electrically connected to one another at the beginning and end of the coil 1. The electrical conductors 2, 2' are arranged parallel to one another over the entire length of the coil 1. The coil 1 preferably has an electrical contact 4 at the beginning and end, by means of which the coil 1 can be electrically connected. In one embodiment, as shown in FIG. 5, the coil 1 has a square shape in cross section.

Figure 6:
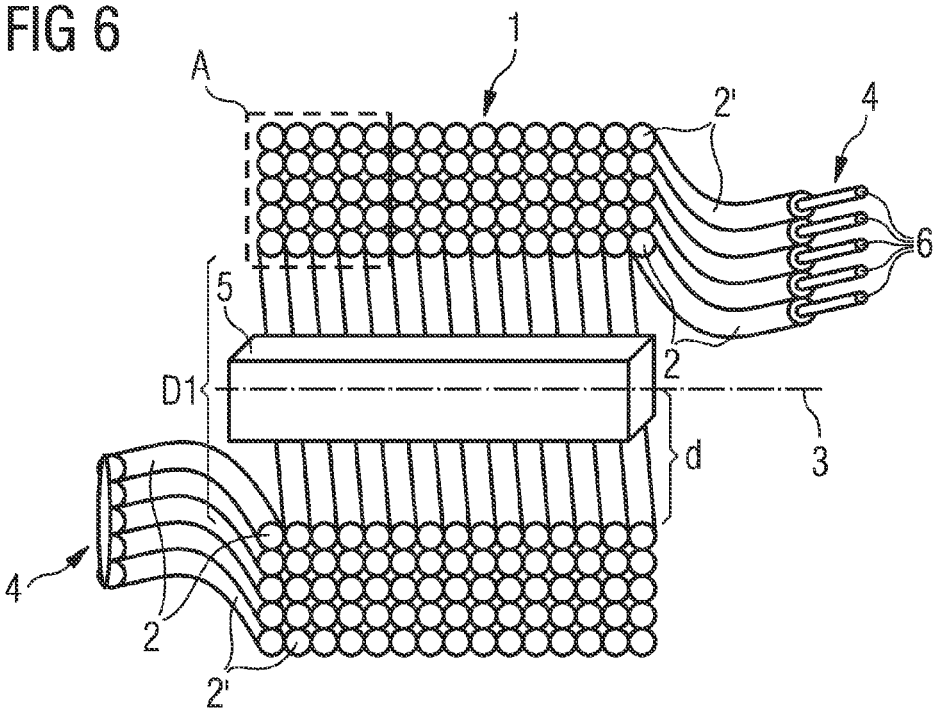
FIG. 6 shows a schematic design of an alternate embodiment of a coil.

In a further embodiment shown in FIG. 6, the ends of the electrical conductors 2 and 2' are each connected to separate contact pins 6. As a result of the additional contact pins or solder pins 6, higher mechanical loads can be exerted on the contacts without the ends changing their original position and shape.

As a result of the windings of the electrical conductors 2, 2', the coil 1 has sufficient stability that the coil 1 does not require an additional coil body. A ferrite core 5 can be inserted in the winding center 3 of the coil 1. Alternatively, the coil 1 can also be pushed onto the arms of a ferrite core, for example, which has an E-shape. Preferably, the coil 1 is spread out in the vicinity of the air gap of the E-cores, resulting in a kind of cushion in the vicinity of the air gap of the S-cores. Ideally there are no or as few as possible turns in the vicinity of the cushion.

In FIG. 1, part of the turns is marked as region A. The region is shown enlarged in FIG. 2.

Figure 2:
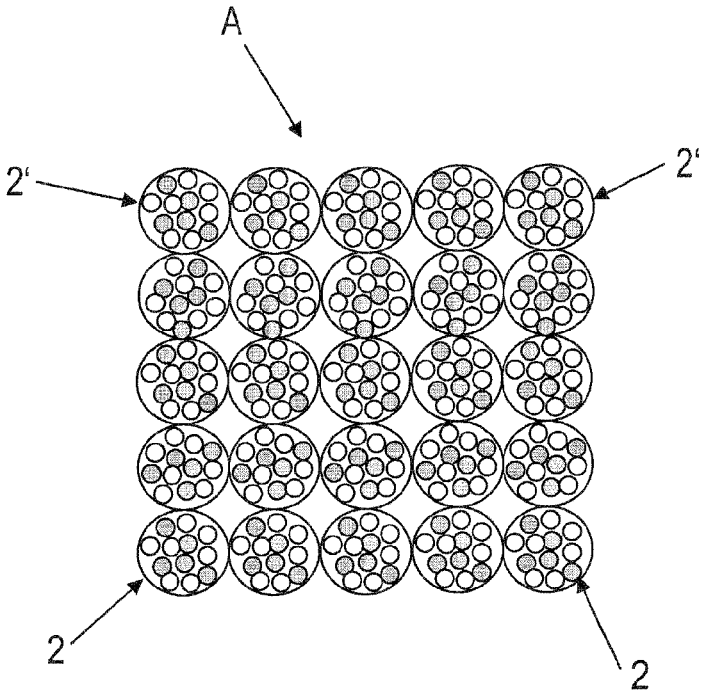
FIG. 2 shows a schematic design of the windings of a coil.

A section of the coil from FIG. 1 is shown in FIG. 2. In FIG. 2, the electrical conductors 2, 2' are shown as stranded conductors. Here, each of the stranded conductors has approximately 12 individual wires which are twisted together and intermeshed. The electrical conductors 2, 2' can also consist of individual wires, rectangular flat wires or other forms of wire however. The individual electrical conductors 2, 2' are arranged exactly on top of one another. The distance of the first electrical conductor 2 from the winding center of the coil 1 is approximately the same magnitude over the entire length. Directly on top of the first electrical conductor 2 is arranged a second 2' and further electrical conductors which are wound together with the first electrical conductor 2 around a common winding center.

Figure 3:
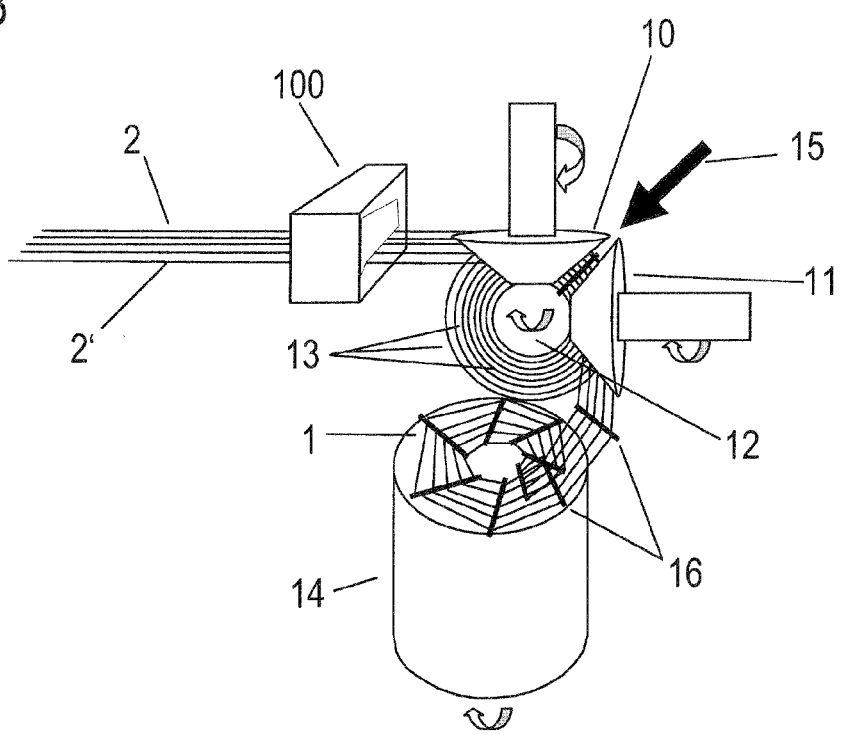
FIG. 3 shows schematically a first device for producing a coil.

FIG. 3 shows schematically a first possible arrangement for producing a coil 1 which is shown in FIGS. 1 and 2. To produce a coil 1, a plurality of electrical conductors 2, 2' are fed to a first pressure roller 10 via a wire guide 100. The first pressure roller 10 presses the electrical conductors 2, 2' onto guides 13 of a guide roller 12. The shape of the first pressure roller 10 is matched to the guide roller 12 and rotates at the same speed as the guide roller.

In the arrangement shown, the guide roller 12 has a tapered form. The electrical conductors 2, 2' are fed around the guide roller 12 on differently sized concentric guide channels. As a result of the tapered shape of the guide roller, the electrical conductors 2, 2' are fed at different speeds around the guide roller 12. In order to guide the electrical conductors 2, 2' on the guide roller 12 for approximately a quarter of a revolution, a second pressure roller 11 is arranged at an angle of approximately 90° to the first pressure roller 10. Like the first pressure roller 10, the second pressure roller 11 is matched to the shape and size of the guide roller 12 and rotates at the same speed.

Between the two pressure rollers 10, 11, the electrical conductors 2, 2' are mechanically bonded to one another by means of an infrared linear radiator 15. The electrical conductors 2, 2' have a thermoplastic synthetic sleeve, for example (self-bonding wires), which stick to one another when heated.

The first pressure roller 10 can additionally be heated for this purpose, for example, so that the thermoplastic synthetic sleeve (self-bonding layer) is heated to just below the softening temperature of the synthetic sleeve in the vicinity of the first pressure roller 10. The individual electrical conductors 2, 2' are mechanically bonded to one another by means of infrared light or with a hot air stream. In order to cool the synthetic sleeves, the guide roller 12 and/or the second pressure roller 11 is cooled, for example.

Alternatively, the electrical conductors 2, 2' can also be bonded to one another by means of a UV-hardening adhesive. The adhesive can be applied, for example, as long as the electrical conductors 2, 2' are located in the guides of the guide roller 12. Alternatively, the adhesive can also be applied to the electrical conductors 2, 2' shortly after leaving the guide roller 12. Here, the adhesive is cured by means of UV light from a UV LED array or a flash lamp, preferably within 200 ms.

Adhesive strips can also be used to mechanically bond the electrical conductors 2, 2' to one another. For this purpose, the adhesive strips are simply placed on the guide roller 12 shortly before the first pressure roller with the adhesive coating facing upwards.

In order to achieve adequate stability of the coil 1, it is sufficient when the individual electrical conductors 2, 2' are only bonded to one another at certain points. At the same time, it is sufficient when the electrical conductors 2, 2' are bonded to one another at regular intervals with mechanical bonds 16.

After passing around the guide roller 12, the mechanically bonded electrical conductors 2, 2' have a helical form. The helical form comes about as the length of the outermost electrical conductor 2 is greater than the length of the adjacent electrical conductor 2'. The next adjacent electrical conductor 2, 2' towards the inside is always shorter. If the electrical conductors 2, 2' are endlessly linked in this way, then an endless helical strip is formed, similar to an Archimedean screw. As shown in FIG. 3, the endless strip can be collected in a rotating collection cup 14, for example. The turns automatically lie on top of one another due to gravity, as a result of which the resulting winding is compressed. After achieving the required number of windings, the endless strip can be separated. The loose winding in the collection cup 14 can be further compressed simply by pressing, for example. Alternatively, the winding can also be further compressed by means of a shrink sleeve.

Figure 4:
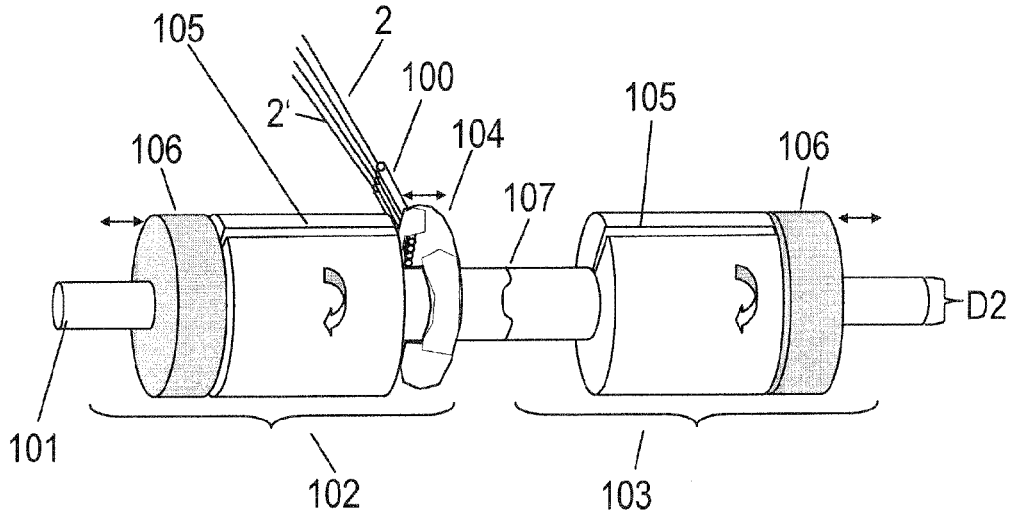
FIG. 4 shows schematically a further device for producing a coil.

A further arrangement for producing a coil 1 is shown schematically in FIG. 4. For this purpose, a plurality of electrical conductors 2, 2' are wound around a rotating axle 101 by means of a two-part winding tool 102, 103. The ends of the electrical conductors 2, 2' are placed in slot-shaped recesses 105 of the first winding tool 102 and fixed by means of a magnet 106. The two halves of the winding tool 102, 103 are set rotating at the same speed and with the same direction of rotation. In order to achieve synchronization of the two winding tools 102, 103, the two halves of the winding tool 102, 103 are connected to one another by means of a coupling 107. However, it is also possible to achieve synchronization of the two halves by means of other technical devices.

The forming winding tool 102, 103 is in two parts to enable the finished winding to be easily removed from the winding tool 102, 103 after winding. The rotating axle 101 preferably has an outside diameter D2 which corresponds to the inside diameter D1 of the coil 1 to be wound.

A wire guide 100 is arranged in the vicinity of the rotating axle 101 to guide the electrical conductors 2, 2'. The electrical conductors 2, 2' are wound on top of one another in the winding plane around the rotating axle 101 by means of the wire guide 100. In doing so, the electrical conductor 2' which has the smallest distance d from the winding center, which here is formed by the rotating axle 101, is fed around the rotating axle 101 at a lower speed than electrical conductors 2 which are arranged further towards the outside. The length of the electrical conductors 2' which are arranged further towards the inside is therefore less than that of the electrical conductors 2 which are arranged further towards the outside. In order to prevent slipping of the already wound windings, a plate 104 is arranged parallel to the wire guide 100. The plate 104 and the wire guide 100 are arranged on a slide which can be moved in the x-direction and which is not shown here for reasons of clarity. The slide moves the wire guide 100 and the plate 104 along the rotating axle 101 as the winding grows. At the same time, due to the significant pressure on already fully wound regions of the coil 1, the plate 104 also prevents these regions from changing their position. When the wire guide 100 has almost reached the inner limit of the right-hand winding tool 103, the ends of the electrical conductors 2, 2' are placed manually or by means of a tool into the slot-shaped recesses 105 of the right-hand winding tool 103. In doing so, the wire guide 100 is no longer moved, enabling further pressure to be exerted on the already wound regions of the coil 1 by the plate 104.

In order to fix the windings, for example, when using electrical conductors 2, 2' with a thermoplastic synthetic sleeve, the synthetic sleeve can be heated above the softening temperature of the synthetic layer by means of an infrared radiator or a hot air stream even while winding. When the winding has cooled to below the softening temperature of the synthetic sleeve, the fully wound coil 1 can be removed from the winding tool 102, 103. The ends of the electrical conductors 2, 2' are previously at least partially removed from the slot-shaped recesses 105 of the two halves of the winding tool to prevent the ends from jamming.

UV-hardening adhesive, which is applied during winding, can also be used to stabilize the winding. In this case, any electrical conductors 2, 2' can be used. The adhesive can penetrate the entire winding, or alternatively only parts thereof, such as the beginning or end of the winding. In a further embodiment, the parts of the arrangement which come into contact with the adhesive can be made of Teflon. This enables epoxy or acrylic resins to be used to stabilize the coil 1 without problems arising when removing from the mold.

When using an additional coil body, around which the electrical conductors 2, 2' are wound, only the start of the winding and the end must be fixed.

Although it has only been possible to describe a limited number of possible developments of the invention in the exemplary embodiments, the invention is not restricted thereto. In principle, it is possible to use further possible arrangements with which a coil described above can be produced.

The invention is not restricted to the number of elements shown.

The description of the subject matter specified here is not restricted to the individual special embodiments; rather, the characteristics of the individual embodiments can be combined with one another in any way as long as this is technically practical.

What is claimed is:

1. A coil comprising:

at least four separate electrical conductors that are connected in parallel, each of the electrical conductors having a circular cross-section;

wherein the electrical conductors are wound around a common winding center, wherein the electrical conductors are arranged aligned on top of one another so that a line crossing a center of each electrical conductor is perpendicular to a line through the common winding center;

wherein the at least four separate electrical conductors are connected to one another at least at the ends of the coil;

wherein the electrical conductors are physically attached to one another locally with mechanical bonding at multiple points along the length of the electrical conductors, wherein the multiple points comprise points that are not just the ends of the electrical conductors, wherein the electrical conductors are not mechanically bonded to one another at any other location other than the multiple points along the length of the electrical conductors, wherein the electrical conductors are electrically insulated from one another at the multiple points with the mechanical bonding, wherein, at the multiple points, the mechanical bonding of the electrical conductors comprises a thermoplastic synthetic material, a UV-hardened adhesive, or a synthetic yarn, wherein the mechanical bonding extends only over the electrical conductors along a radial plane of the coil;

wherein, for each of the at least four electrical conductors, windings are formed such that the conductor is at a constant distance from the winding center of the coil over an entire length of the coil, the constant distance being different for each conductor, wherein the windings of the electrical conductors are arranged adjacent to one another over the entire length of the coil such that the windings of each electrical conductor are arranged next to the windings of an adjacent electrical conductor, and wherein the coil has a self-supporting shape and is inherently mechanically stable without an additional coil body.

2. The coil as claimed in claim 1, wherein the electrical conductors are insulated with respect to one another in a vicinity of the wound electrical conductors.

3. The coil as claimed in claim 1, wherein the electrical conductors make contact with one another at least at ends of the coil.

4. A coil comprising:

at least four separate electrical conductors that are connected in parallel, wherein the electrical conductors each comprise individual wires which are twisted together and intermeshed, wherein the at least four separate electrical conductors are connected to one another at least at the ends of the coil;

wherein the electrical conductors are mechanically bonded to one another locally at multiple points, wherein the multiple points comprise points that are not just the ends of the electrical conductors, wherein, at the multiple points, the mechanical bonding of the electrical conductors comprises a thermoplastic synthetic material, a UV-hardened adhesive, or a synthetic yarn, wherein the mechanical bonding extends only over the electrical conductors along a radial plane of the coil;

wherein the electrical conductors are wound around a common winding center, wherein the electrical conductors are arranged aligned on top of one another so that a line crossing a center of each electrical conductor is perpendicular to a line through the common winding center;

wherein, for each of the at least four electrical conductors, windings are formed such that the conductor is at a constant distance from the winding center of the coil over an entire length of the coil, the constant distance being different for each conductor, wherein the windings of the electrical conductors are arranged adjacent to one another over the entire length of the coil such that the windings of each electrical conductor are arranged next to the windings of an adjacent electrical conductor, and wherein the coil is inherently mechanically stable.

5. The coil as claimed in claim 1, wherein the electrical conductors are bonded to one another at regular intervals.

6. The coil as claimed in claim 1, wherein a length of an inner electrical conductor is less than a length of an adjacent electrical conductor towards an outside over the entire length of the coil.

7. The coil as claimed in claim 1, wherein respective ends of the electrical conductors have electrical contacts.

8. The coil as claimed in claim 7, wherein the ends of the electrical conductors are connected to contact pins.

9. The coil as claimed in claim 1, further comprising a ferrite core is arranged in the winding center.

10. The coil as claimed in claim 1, wherein the coil has a square shape in cross section.

11. The coil as claimed in claim 1, wherein the coil is sleeved with a casting compound.

12. A coil comprising a plurality of electrical conductors, the coil comprising:

a first conductor wound around a winding center such that windings of the first conductor extend laterally over an entire length of the coil, wherein each winding of the first conductor is at a first constant distance from the winding center of the coil over the entire length of the coil;

a second conductor wound around the winding center over the first conductor such that windings of the second conductor extend laterally over the entire length of the coil, wherein each winding of the second conductor is at a second constant distance from the winding center over the entire length of the coil, the second constant distance larger than the first constant distance, the second conductor being electrically coupled in parallel with the first conductor;

a third conductor wound around the winding center over the second conductor such that windings of the third conductor extend laterally over the entire length of the coil, wherein each winding of the third conductor is at a third constant distance from the winding center over the entire length of the coil, the third constant distance larger than the second constant distance, the third conductor being electrically coupled in parallel with the first and second conductors; and a fourth conductor wound around the winding center over the third conductor such that windings of the fourth conductor extend laterally over the entire length of the coil, wherein each winding of the fourth conductor is at a fourth constant distance from the winding center over the entire length of the coil, the fourth constant distance larger than the third constant distance, the fourth conductor being electrically coupled in parallel with the first, second and third conductors, wherein the first, second, third and fourth conductors are arranged aligned on top of one another so that a line crossing a center of each conductor is perpendicular to a line through the winding center, wherein the first, the second, the third, and the fourth conductors are connected to one another at least at the ends of the coil, and wherein the first, the second, the third, and the fourth conductors are mechanically bonded to one another locally, with mechanical bonding, only at multiple points along the length of the electrical conductors, wherein the first, the second, the third, and the fourth conductors are electrically insulated with respect to one another at the multiple points with the mechanical bonding, wherein, at the multiple points, the mechanical bonding of the electrical conductors comprises a thermoplastic synthetic material, a UV-hardened adhesive, or a synthetic yarn, wherein the mechanical bonding extends only over the electrical conductors along a radial plane of the coil.

13. The coil as claimed in claim 12, wherein has a self-supporting shape and is inherently mechanically stable without an additional coil body.

14. The coil as claimed in claim 12, wherein the windings of electrical conductors are electrically insulated with respect to one another.

15. The coil as claimed in claim 12, wherein ones of the electrical conductors make contact with one another at least at ends of the coil.

16. The coil as claimed in claim 12, wherein each electrical conductor comprises individual wires that are twisted together and intermeshed.

17. The coil as claimed in claim 12, wherein the electrical conductors are bonded to one another at regular intervals.

18. The coil as claimed in claim 12, wherein respective ends of the electrical conductors have electrical contacts.

19. The coil as claimed in claim 18, wherein the ends of the electrical conductors are connected to contact pins.

20. The coil as claimed in claim 12, further comprising a ferrite core is arranged in the winding center.

21. The coil as claimed in claim 12, wherein the coil has a square shape in cross section.

22. The coil as claimed in claim 12, wherein the coil is sleeved with a casting compound.

23. The coil as claimed in claim 1, wherein the at least four separate electrical conductors are connected to one another at least at the ends of the coil using solder links.

24. The coil as claimed in claim 1, wherein the electrical conductors are bonded to one another at irregular intervals.

* * * * *